US011543780B1

(12) United States Patent
Garcia

(10) Patent No.: US 11,543,780 B1
(45) Date of Patent: Jan. 3, 2023

(54) TIME DISPLAYING APPARATUS

(71) Applicant: Christopher George Garcia, Richardson, TX (US)

(72) Inventor: Christopher George Garcia, Richardson, TX (US)

( * ) Notice: Subject to any disclaimer, the term of this patent is extended or adjusted under 35 U.S.C. 154(b) by 683 days.

(21) Appl. No.: 16/660,931

(22) Filed: Oct. 23, 2019

(51) Int. Cl.
*G04G 9/10* (2006.01)
*G04G 5/00* (2013.01)

(52) U.S. Cl.
CPC ..... *G04G 9/10* (2013.01); *G04G 5/007* (2013.01)

(58) Field of Classification Search
CPC ..... G04G 9/10; G04G 5/007
USPC ..... 368/113
See application file for complete search history.

(56) References Cited

U.S. PATENT DOCUMENTS 3,596,462 A * 8/1971 Hayes ..... G04G 9/04 D10/15
5,526,327 A * 6/1996 Cordova, Jr. ..... G04B 45/00 368/239
2006/0039242 A1* 2/2006 Ford ..... G04B 19/10 368/231
2011/0038232 A1* 2/2011 Su ..... G04G 9/042 368/82
2012/0170424 A1* 7/2012 Zhou ..... G04G 9/102 368/10
2017/0289252 A1* 10/2017 Zriashchev ..... G04G 21/04

* cited by examiner

*Primary Examiner* — Kerri L McNally
(74) *Attorney, Agent, or Firm* — Jeffrey Roddy

(57) ABSTRACT

A time keeping apparatus includes a first region and a second region, the first and second regions are separated by a border. The first region includes a array of minutes indicators, each indicator represents at least 1 minute, and the second region includes a array of stacked hour indicators, each hour indicator representing 1 hour. Each stacked indicator is separated from an abutting stacked indicator.

6 Claims, 17 Drawing Sheets

TIME DISPLAYING APPARATUS

BACKGROUND OF THE INVENTION

Technical Field

This invention relates to timepieces, and more particularly, to an electrical device for displaying time.

Description of Related Art

U.S. Pat. No. 7,835,231 to Garcia describes a linear clock with a stacked arrangement of indicators that show a unique hour section, a unique five-minute section and unique one-minute section. U.S. Pat. No. 9,891,588 also to Garcia includes twelve linearly arranged regions wherein each region includes an indicator termed a "marker," which is capable of representing a unique hour with a twelve hour cycle or a block of time equal to a five minute increment. Interspersed with the twelve linearly arranged regions is a group of four indicators that are capable of representing a one-minute increment and collectively, up to four minutes.

While the foregoing patents describe vastly different methods of showing time than past art, it would be desirable to provide improvements to a linear clock providing a fully functioning clock capable of displaying hours and minutes that is intuitively understandable and versatile and adaptable to various design implementations.

It would be desirable if such a foregoing device divided a field of a time keeping apparatus into a minutes region and a hours region.

It would be further desirable if the foregoing regions were separated by a border.

SUMMARY OF THE INVENTION

A general example implementation according to the present invention comprises a a time displaying field that includes a minutes displaying region, and an hours displaying region. The minutes displaying region can include up to 60 minute indicators that are typically lighted by LEDs. The hours region includes 12 stacked hour indicators that are likewise typically lighted by LEDs. Time may be shown by additive means in which lighted hour and minute indicators are counted to obtain the time; i.e., the time of 11:30 would be shown as 11 aggregate lighted hour indicators and 30 aggregate lighted minute indicators. Alternatively, 11:30 may be shown by illuminating only the minute indicator in the $30^{th}$ position of an array of indicators, and the hour indicator in the $11^{th}$ stacked position. In some cases, the minute indicators may be lighted in aggregate while the hour indicators are selectively lighted depending on position in the stack. Likewise, in some cases all indicators indicating the current time will be more brightly lit than adjacent "inactive" indicators. Accordingly, the entire field of the display may be lighted at all times, but indicators indicating the current time are differentiated by brightness, contrast, hue, or other behavior such as pulsing.

In an aspect combinable with the general implementation, the number of minute indicators may include 59 indicators in offset rows and columns.

In a third aspect combinable with the general implementation, the number of minute indicators may be 16, and each indicator may indicate one minute or a five minute increment.

In a fourth aspect combinable with the third aspect, 12 minute indicators may surround 4 minute indicators.

In a fifth aspect combinable with the fourth aspect, each of the 12 minute indicators may represent a 5 minute increment, while each of the 4 indicators may represent a 1 minute increment.

In a sixth aspect combinable with the general implementation, the number of minute indicators may be 15, and include 11 five-minute indicators and 4 one-minute indicators.

Figure 1:
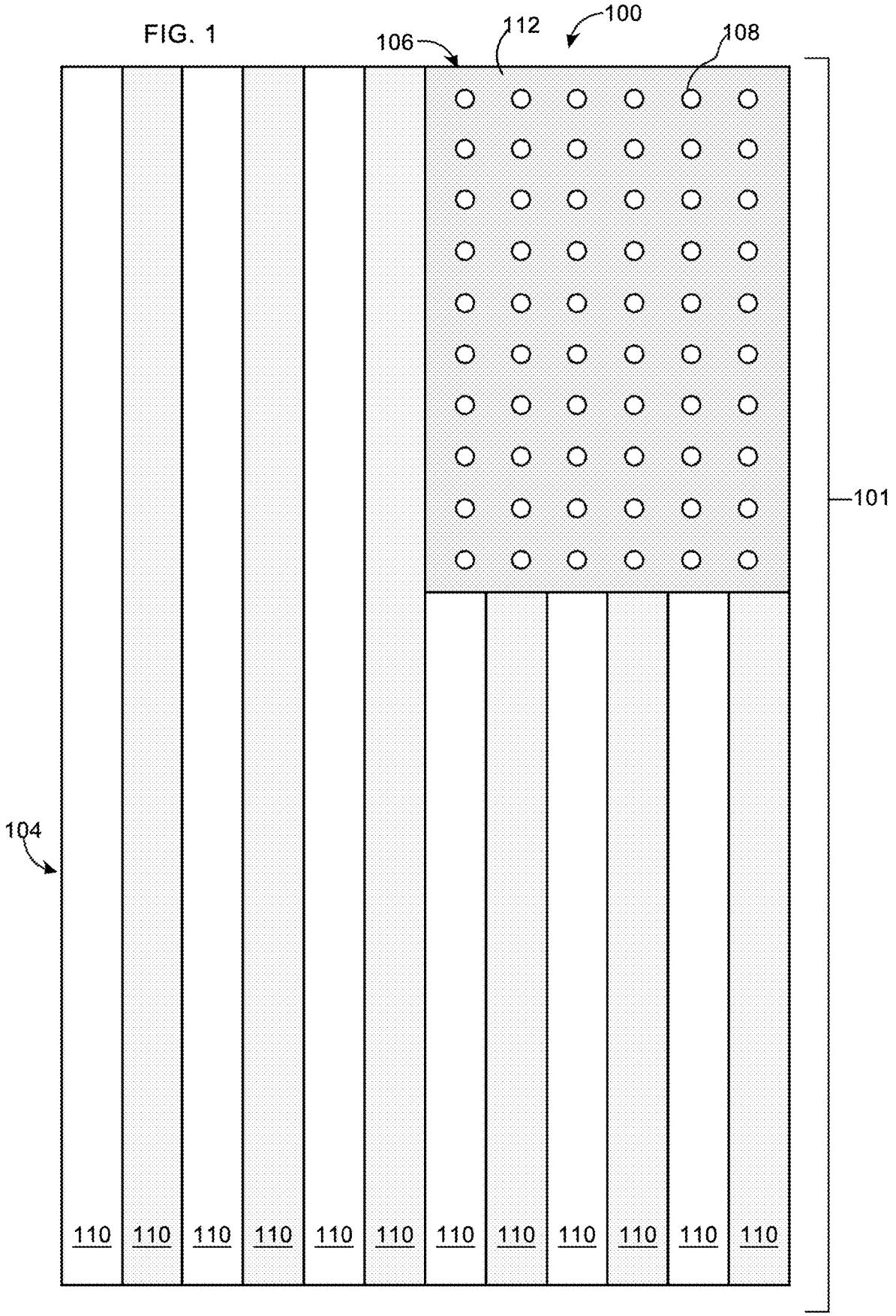
FIG. 1 is a plan view of an example implementation according to the present invention, including 60 minute indicators arranged in rows and columns.

Other advantages of the present invention will become apparent from the following descriptions, taken in connection with the accompanying drawings wherein by way of illustration and example, exemplary implementations of the present invention are disclosed.

LISTING OF THE NUMBERED REFERENCES (100) time displaying device
(101) time displaying field
(104) hours region
(106) minutes region
(108) minute indicator
(109) five-minute increment indicator
(110) hour indicator
(112) background (114) minutes array
(115) zero minute position
(116) four minutes indicator group
(120) substrate Definitions In the following description, the term "indicator" refers generally to a visual indicator, sign or symbol distinguishable from a background. An indicator may represent a minute, a number of minutes or a specific hour, and may include a change in behavior in response to automated timekeeping means such as a timer circuit and may be manually changed by a user. The term "array" means an ordered series or arrangement of objects. The term "background" refers to area(s) adjacent an indicator that may be a decorative element of the time displaying apparatus. The term "substrate" refers to any non-indicator area adjacent to indicators which may be any surface to which the indicators are attached, a surface on which the indicators are resting, a surface in which the indicators are embedded or a surface on which the indicators are displayed. The term "activation" typically refers to programmed behavior of the indicators actively showing the current time, as differentiated by other inactive indicators, and does not imply that indicators next to elements actively displaying the current time are unlit. Instead, the term refers to any behavioral characteristic differentiating time indicators actively displaying the current time from adjacent inactive indicators. The elements that light the indicators are considered separate elements, hence the indicators may be colored plastic, clear plastic, a lens, a void, or an element that is readily differentiated from a background at least when the indicator is lighted. Each hour indicator exclusively displays a unique whole hour in a 12 hour system and may toggle on (lighted) state or toggle off (non-lighted) state. Minute indicators display collectively a number of minutes between whole hours and each minute indicator or a group of minute indicators may switch on to an (lighted) state or switch off to a (non-lighted) state. When lighted, hour or minute indicators may dim, pulse, shift colors or display other behavior corresponding to daytime or nighttime. In some cases, a background or substrate may be lighted, albeit dimly, and contrast with symbols in the foreground.

Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. It should be understood that the objects, features and aspects of any embodiment disclosed herein may be combined with any object, feature or aspect of any other embodiment without departing from the scope of the invention. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

DETAILED DESCRIPTION OF THE INVENTION

Referring generally to FIGS. 1-18, a time displaying device (100) includes a time displaying field (101); the field includes a top boundary, a bottom boundary and side boundaries. Field (101) encompasses a first minutes region (106) and a second hours region (104). The first region and second region are separated by a border. The first region includes a array of minute indicators (108). The second region (104) includes a group of stacked hour indicators (110). Each indicator of the group of stacked hour indicators includes a width and a length, and each stacked hour indicator is differentiated from an abutting stacked hour indicator by color or another visually differentiated characteristic such as bordering, texture, degree of illumination or light display behavior. The various implementations include different minute arrays (114), with some minute indicators arranged in rows and columns and other implementations include a circular or concentric configuration. In some implementations, current time indicators may represent time in aggregate; e.g., 20 minutes indicated by 20 of 60 minute indicators (108) lighted with the remaining indicators unlit or more dimly lighted in order to show contrast. In other implementations, position of a minute indicator shows the current time; e.g., the $20^{th}$ indicator in an array of 59 or 60 indicators is brightly lit. Likewise, the current time may be shown in aggregate hours; e.g., 10 abutting hour indicators (110) are brightly lit distinguishing them from unlit indicators for 10:00. In other implementations, the current hour may be shown by the hour indicator position in the stack. In some implementations, background (112) may be colored and opaque. In other implementations background (112) may be colored and translucent. Likewise, lighted indicators (108, 110) may pulse slowly, or change color to distinguish them from the background. Generally, a controller and wiring/circuit(s) are placed behind the field inside a casing (FIG. 18). While the invention is directed primarily to an apparatus for displaying time in a particular manner and not a particular electronic circuit, persons having skill in the art and access to this disclosure will appreciate that activation of the appropriate LED lighted indicators to display the current time may be accomplished by any number of known methods, e.g., by obtaining the instant time by polling a clock or timer circuit that may contain a readily available timer integrated circuit (IC) such as the DS1307, DS3231— also known as a real-time clock modules, or any chip capable of outputting time in a binary, decimal or hex format whereby at least the hours and minutes may be derived and programmable logic used to activate the hour indicators and one-minute indicators. Alternately, time may updated by NTP, GPS or radio signal.

Moving to FIG. 1, a time displaying device (100) includes a field (101) with a top edge, bottom edges and side edges. Field (101) is divided by a minutes region (106), occupying approximately 25% of the field (101), and a hours region (104). Minutes region (106) includes a number of minute indicators (108) and a background (112) distinguishable from the minute indicators (108). The particular implementation shown has 60 minute indicators and 12 stacked hour indicators (110).

Figure 2:
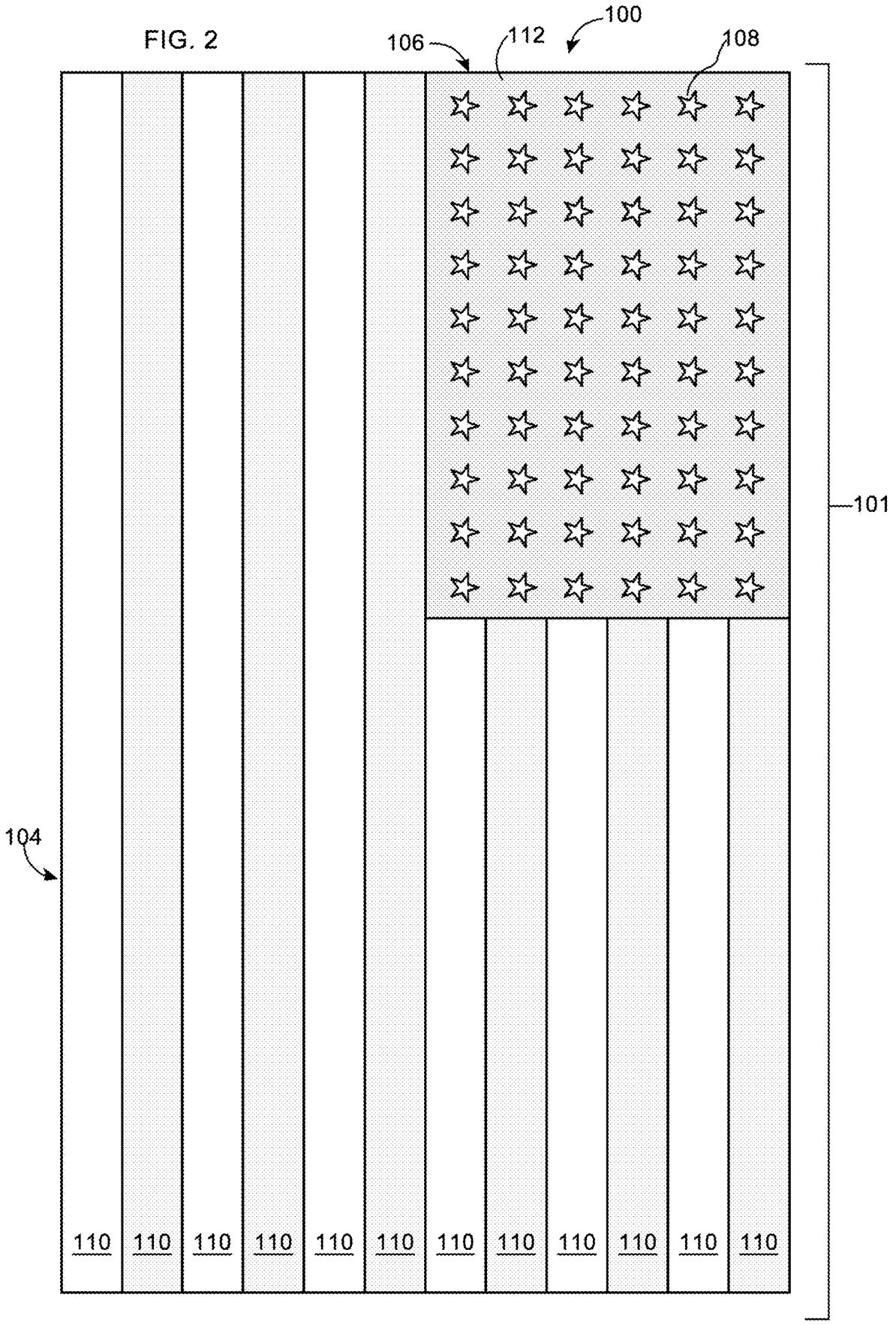
FIG. 2 is a plan view of another example implementation according to the present invention.

FIG. 2 shows an example implementation similar to that in (FIG. 1), however with star shaped minute indicators in lieu of circular minute indicators (108). Accordingly, the shape and size of the minute indicators can vary within a suitable range and still permit the indicators to fit within region (106). In some implementations, the hour indicators (110) may be alternating rectilinear translucent red and white sections. In some implementations, current time hour indicators (110) or current time minute indicators (108) are lit more brightly than adjacent elements, while in other implementations, it is the behavior (e.g., pulsing, color shift, etc.) of the current time indicators that differentiate them from the background.

Figure 3:
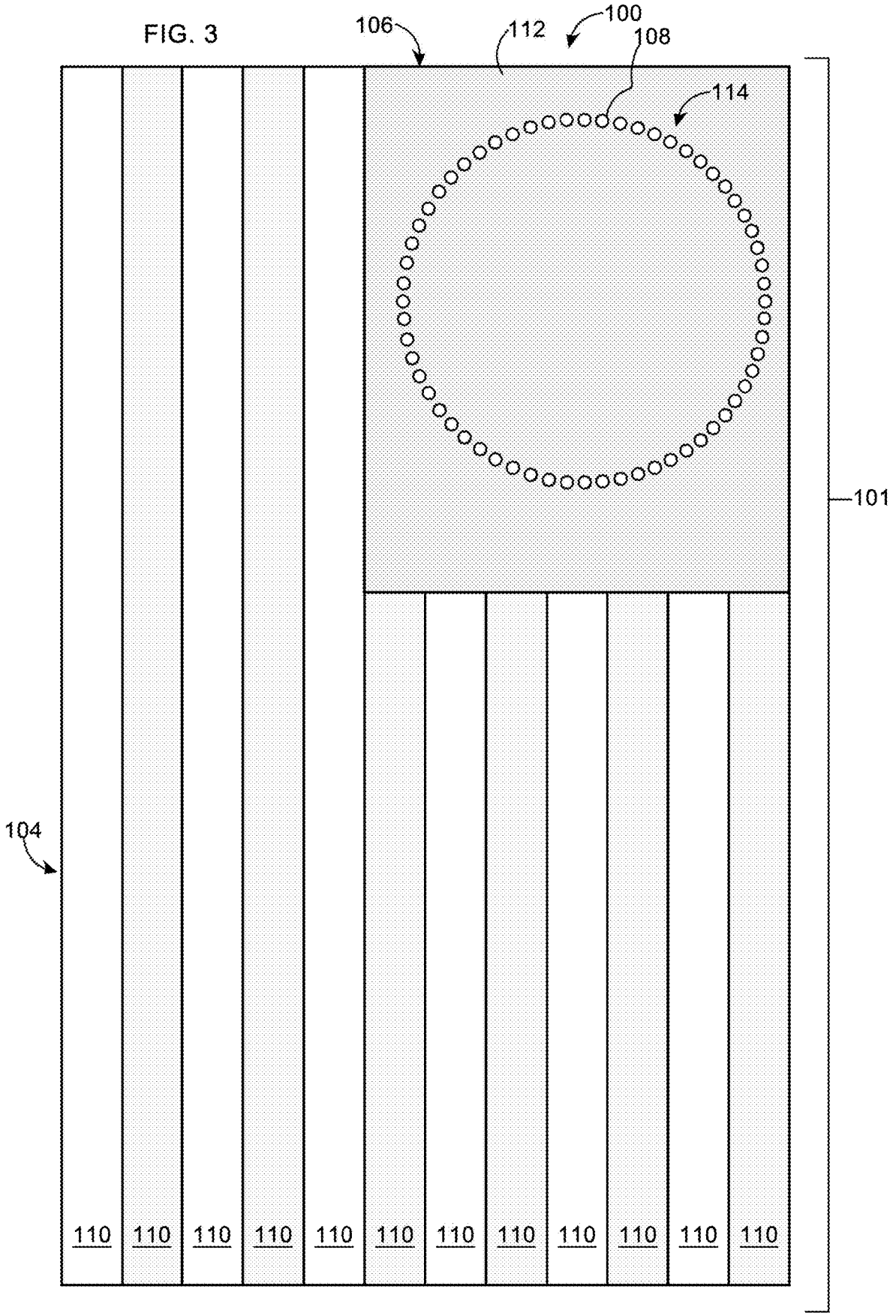
FIG. 3 is a plan view of a third example implementation according to the present invention.
Figure 4:
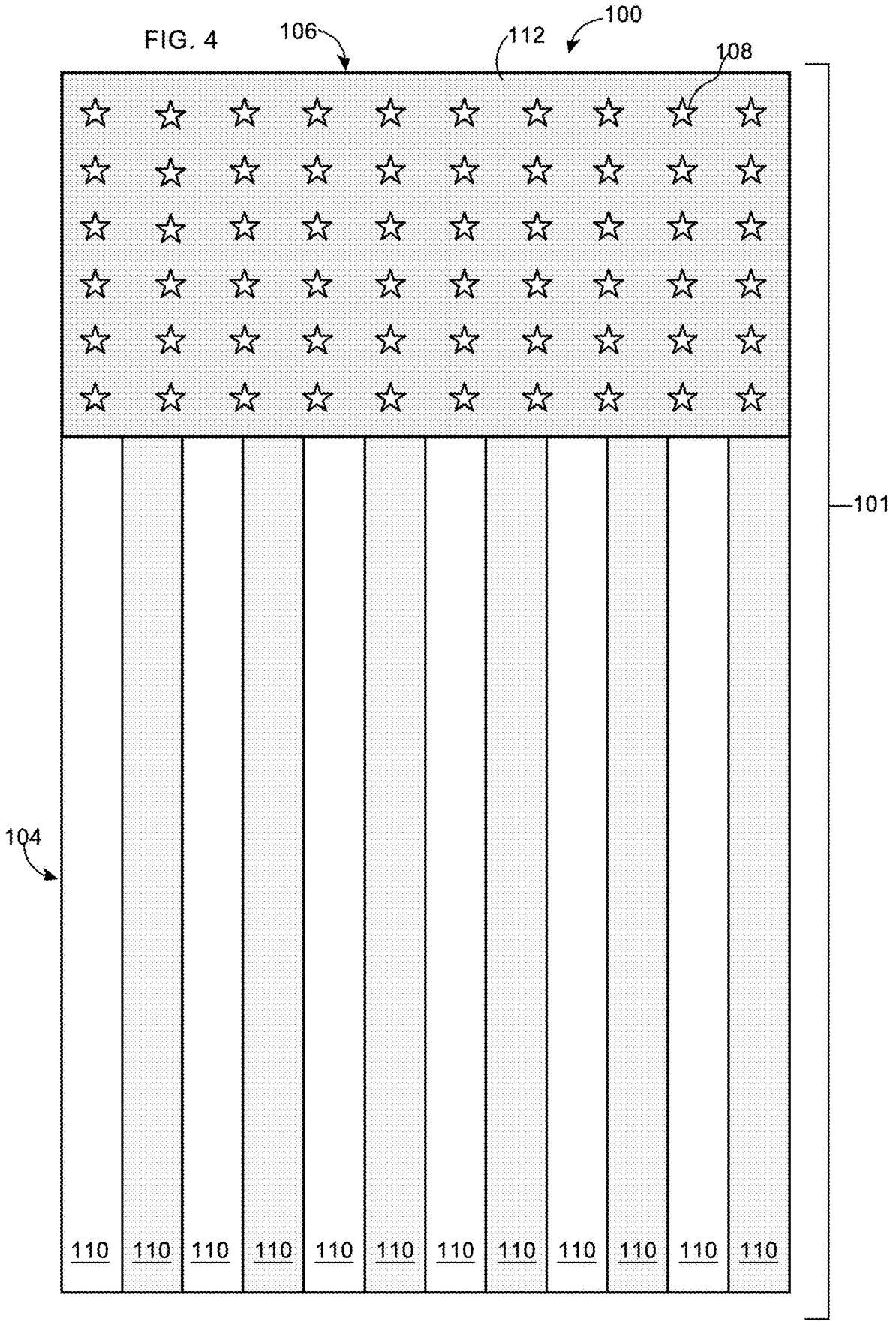
FIG. 4 is a plan view of a fourth example implementation according to the present invention.

FIG. 3 shows an example implementation that includes minutes indicators (108) in a circular array instead of an arrangement of rows and columns. In the particular display shown, the minute indicators (108) number 60. Hour indicators (110) number 12. FIG. 4 includes a minutes region (106) including 60 one-minute indicators (108), the minutes region occupying the entire width of field (101). In some implementations, the current time would be indicated by active (e.g., lighted) minute indicators read left to right or top to bottom. Some implementations such as FIG. 4 may be displayed with the minute region at the top or bottom of field (101) and the hour indicators disposed vertically, or, conceivably, with the hour indicators disposed horizontally.

Figure 5:
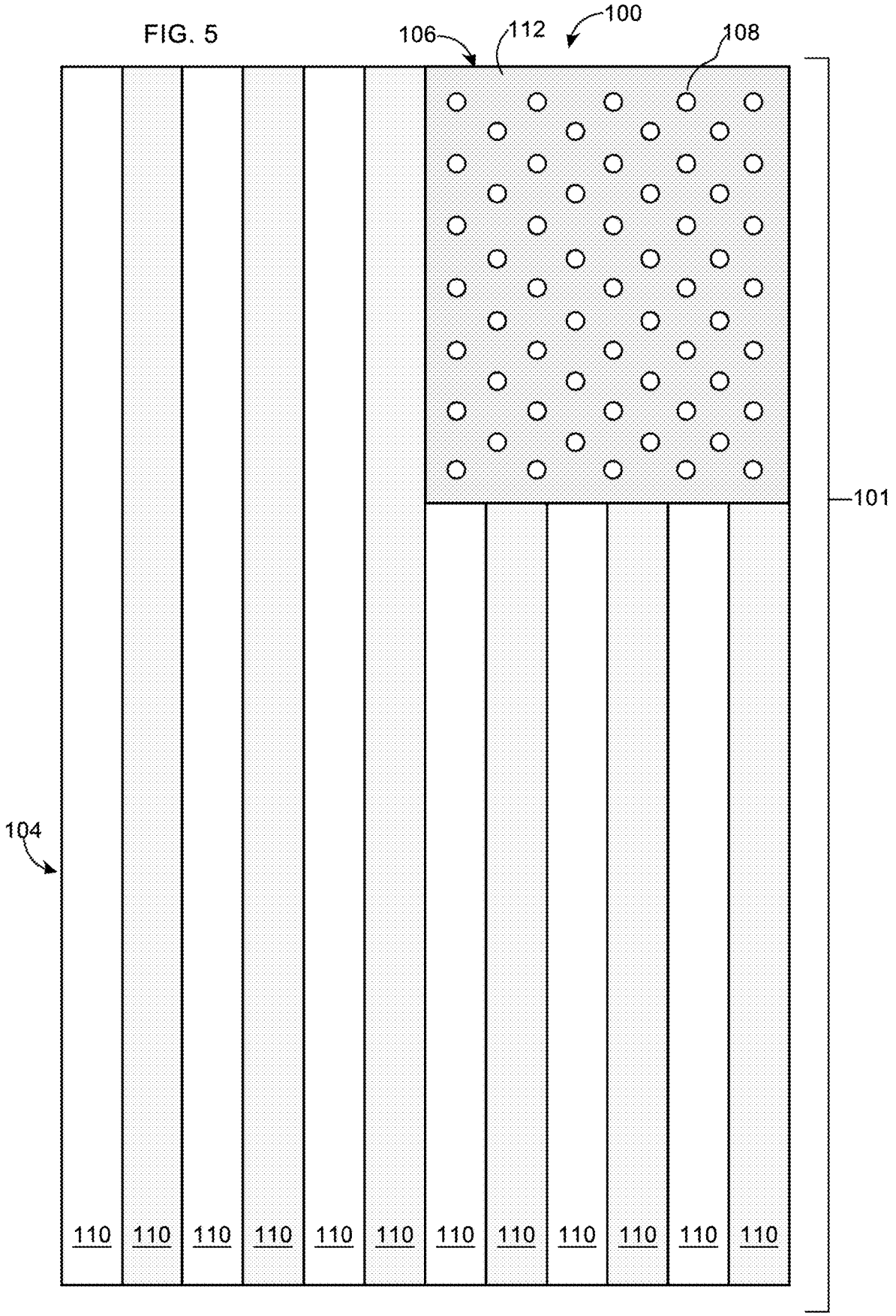
FIG. 5 is a plan view of a fifth example implementation according to the present invention that includes 59 minute indicators arranged in rows and columns.

FIG. 5 shows an example implementation that includes a minutes region (106) with 59 one-minute indicators (108). Typically, the one-minute indicators showing the current number of minutes would activate sequentially showing the number of elapsed minutes in aggregate, until change of hour, at which point 59 active one-minute indicators (108) would instantaneously resume a passive state until the passage of one minute at which point one of the 59 indicators would become reactivate.

Figure 6:
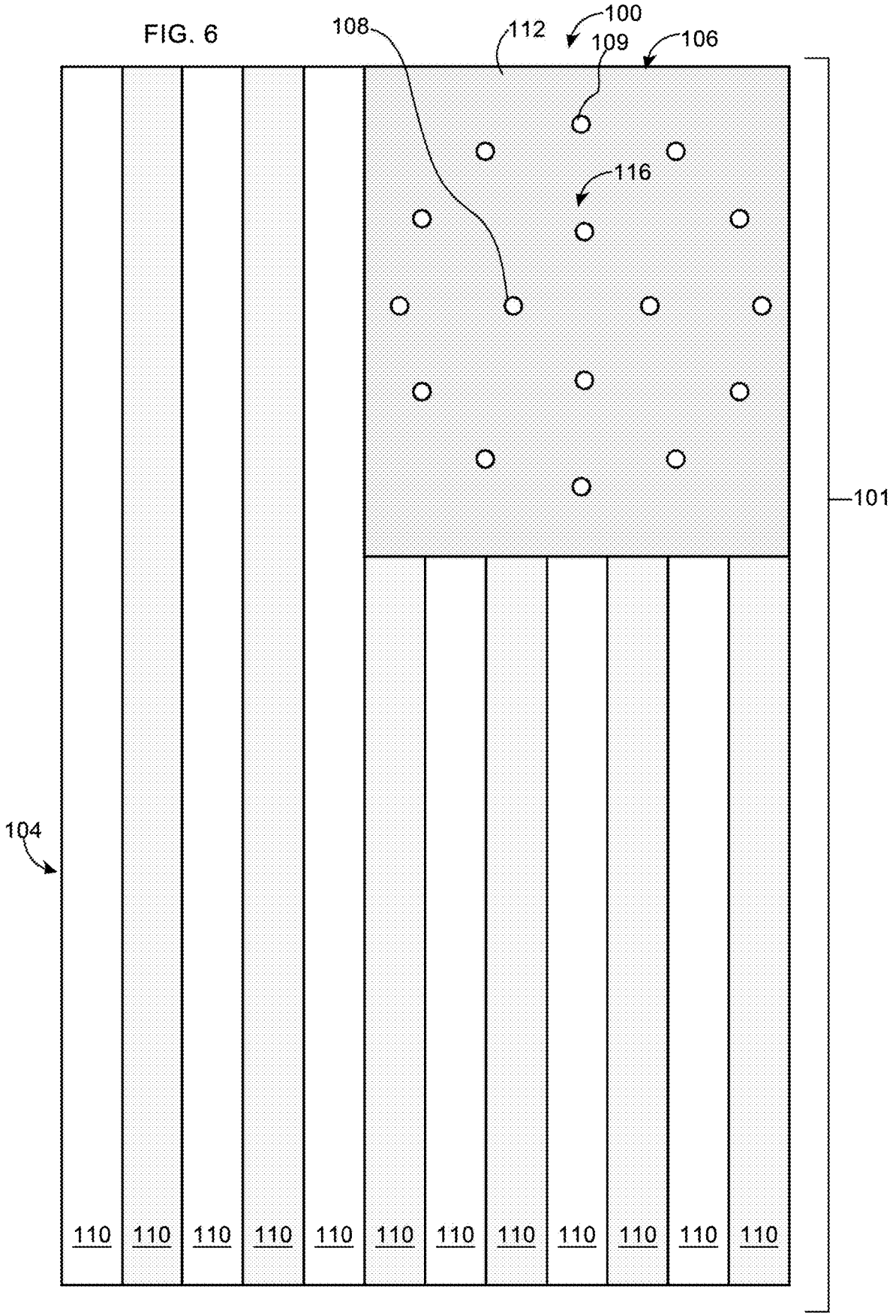
FIG. 6 is a plan view of a sixth example implementation according to the present invention with 4 one-minute indicators surrounded by 12 five minute increment indicators.

FIG. 6 shows an example implementation that includes 12 five-minute indicators in a circular array surrounding 4 one-minute indicators. In practice, one or more of the five-minute indicators would display the minutes as multiples of 5 with the one-minute indicators indicating minutes 1-4 or 6-9.

Figure 7:
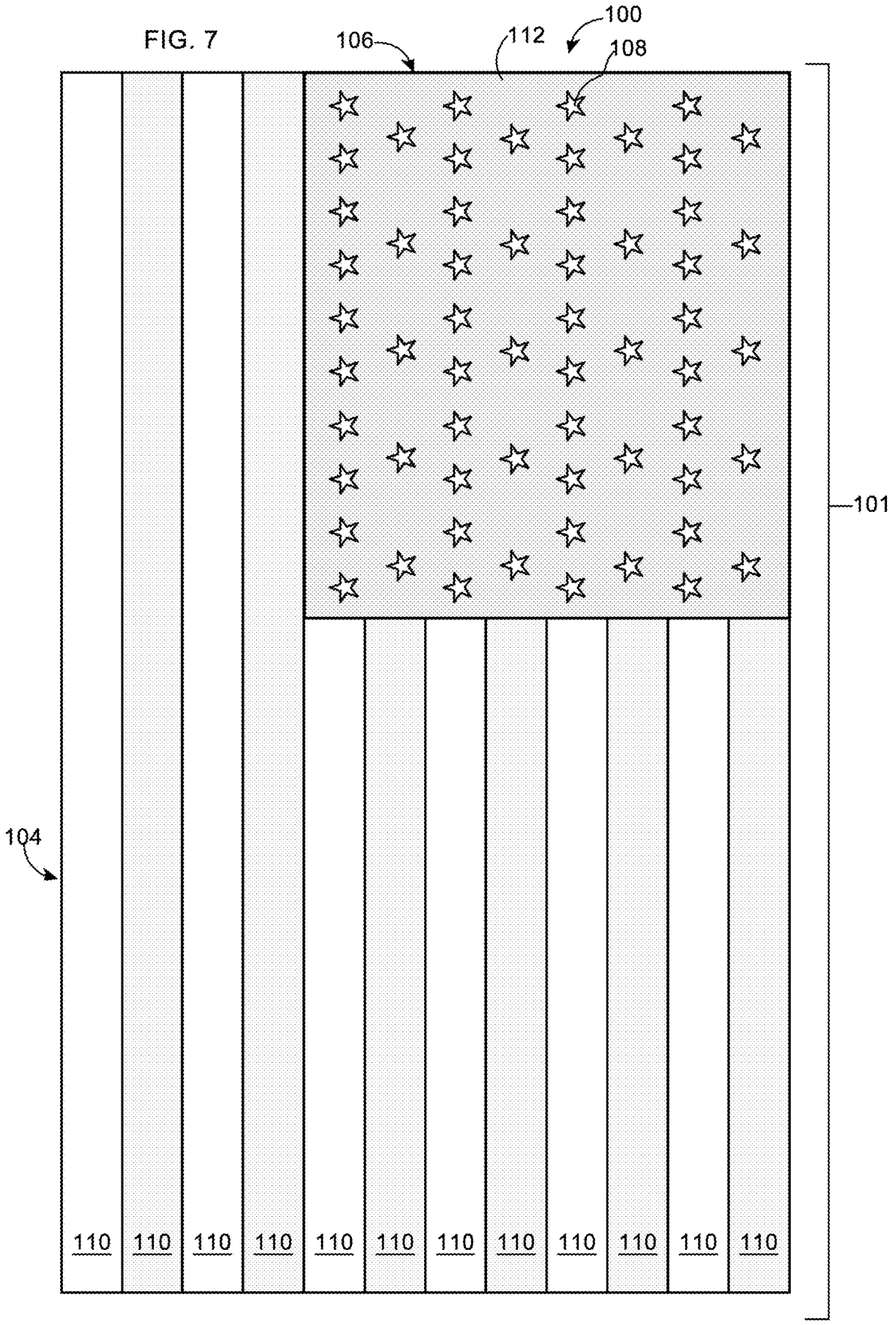
FIG. 7 is a plan view showing an example implementation with 60 one-minute increment indicators arranged in rows and columns.

FIG. 7 shows an example implementation that includes 60 one-minute indicators arranged in alternating rows of 5 and 10 indicators. In this way, 15 minute increments may be recognized quickly whenever two rows are activated.

Figure 8:
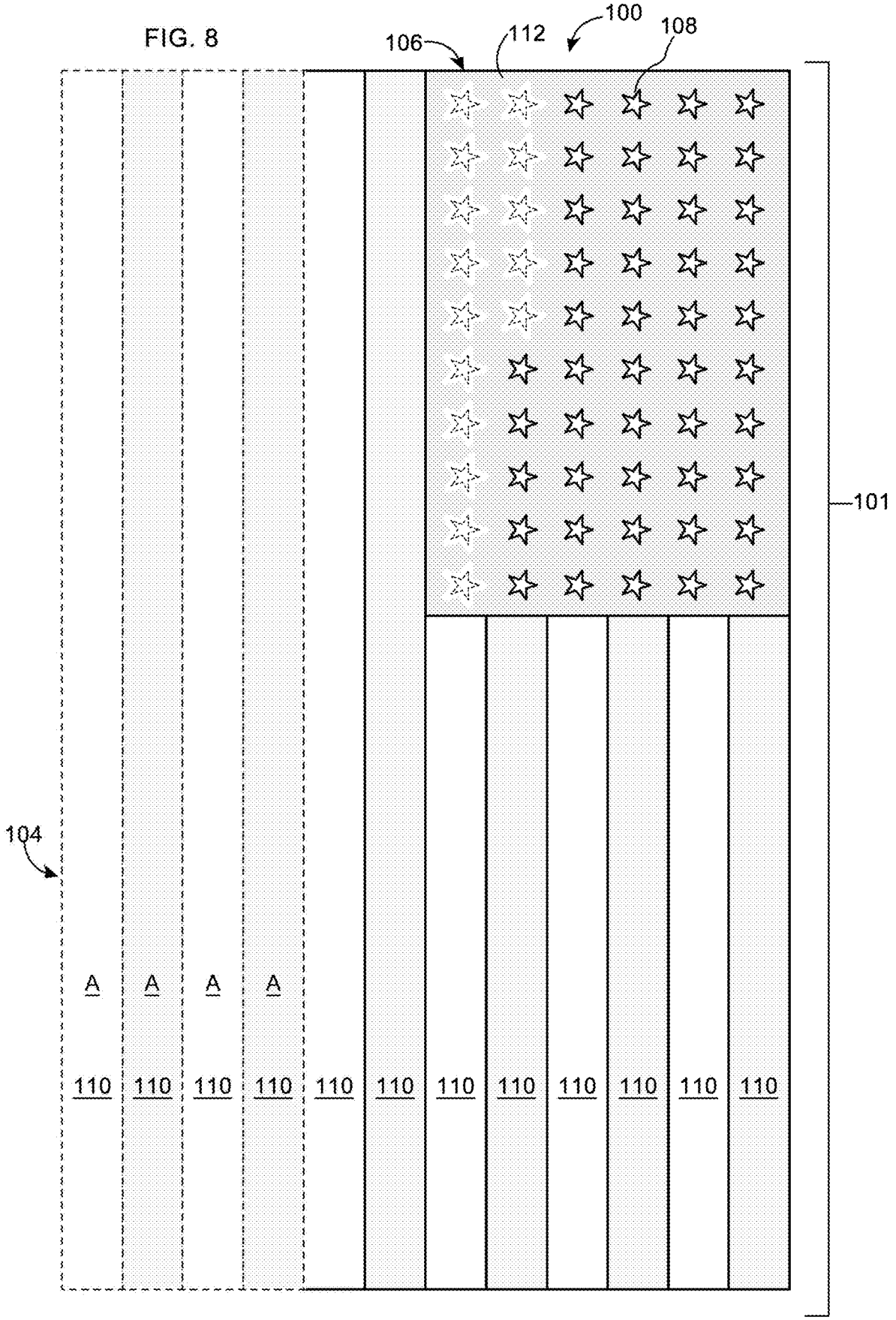
FIG. 8 shows the implementation of (FIG. 2) displaying the time of 4:15.

FIG. 8 shows the implementation of (FIG. 2) displaying the time of 4:15. In a preferred sequencing, hours are activated from the bottom to top and the minutes are activated bottom to top and left to right order. In the example shown, the bottom 4 hour indicators (110) are activated (A) and 15 minute indicators (108) are activated bottom to top and left to right order such that each row is activated completely prior to moving to a superior row. In this case, the activated indicators are more brightly lit than other indicators or the background (112). In some cases, some implementations may be programmed such that the minute indicators are read from the top down.

Figure 9:
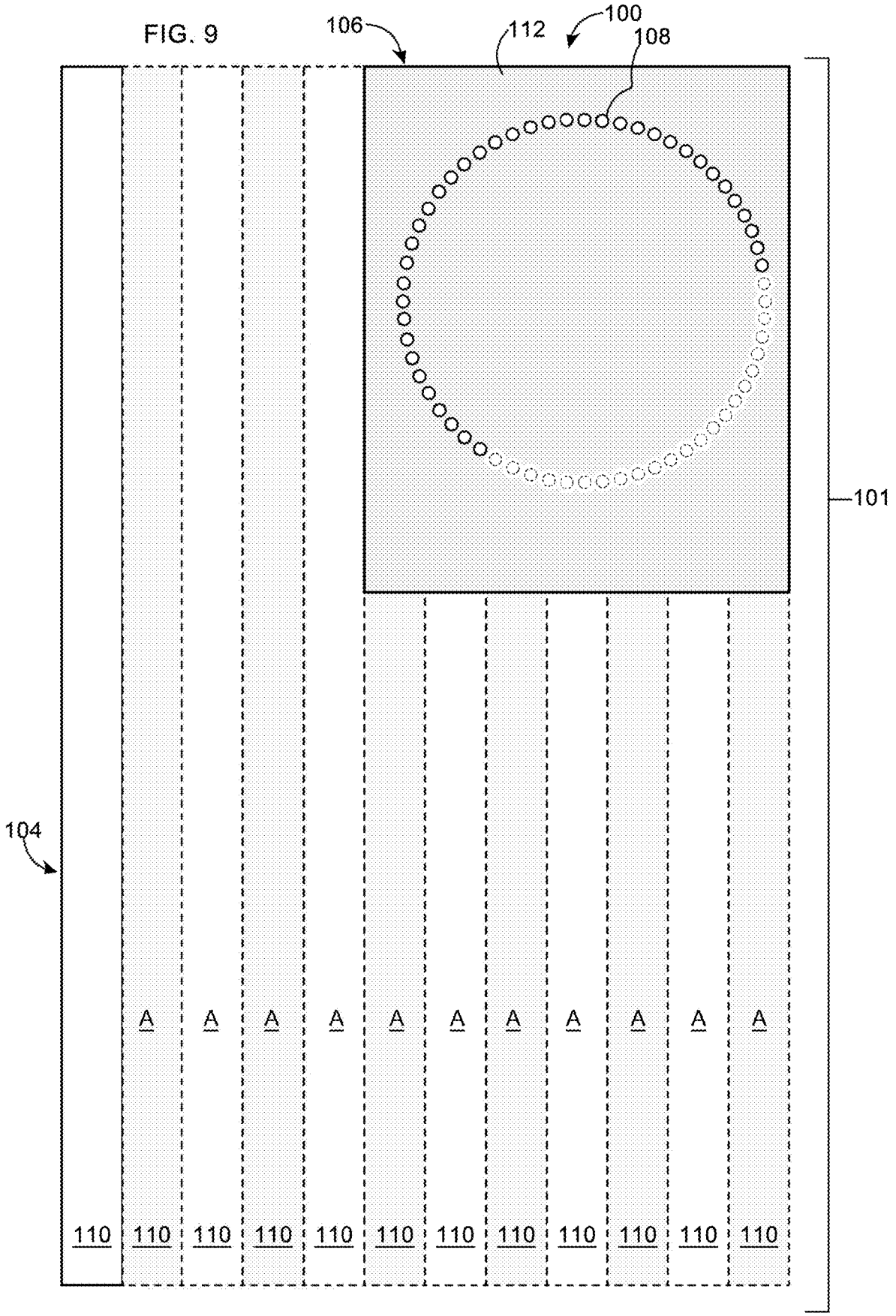
FIG. 9 is a plan view of the example implementation shown in (FIG. 3) displaying the time of 11:23.

FIG. 9 shows the implementation of (FIG. 3) displaying the time of 11:23. Reading the hour indicators (110) from the top down, there are 11 active (A) hour indicators. In the minutes region (106), there are 23 lighted indicators starting at the 12 o-clock position and moving clockwise.

Figure 10:
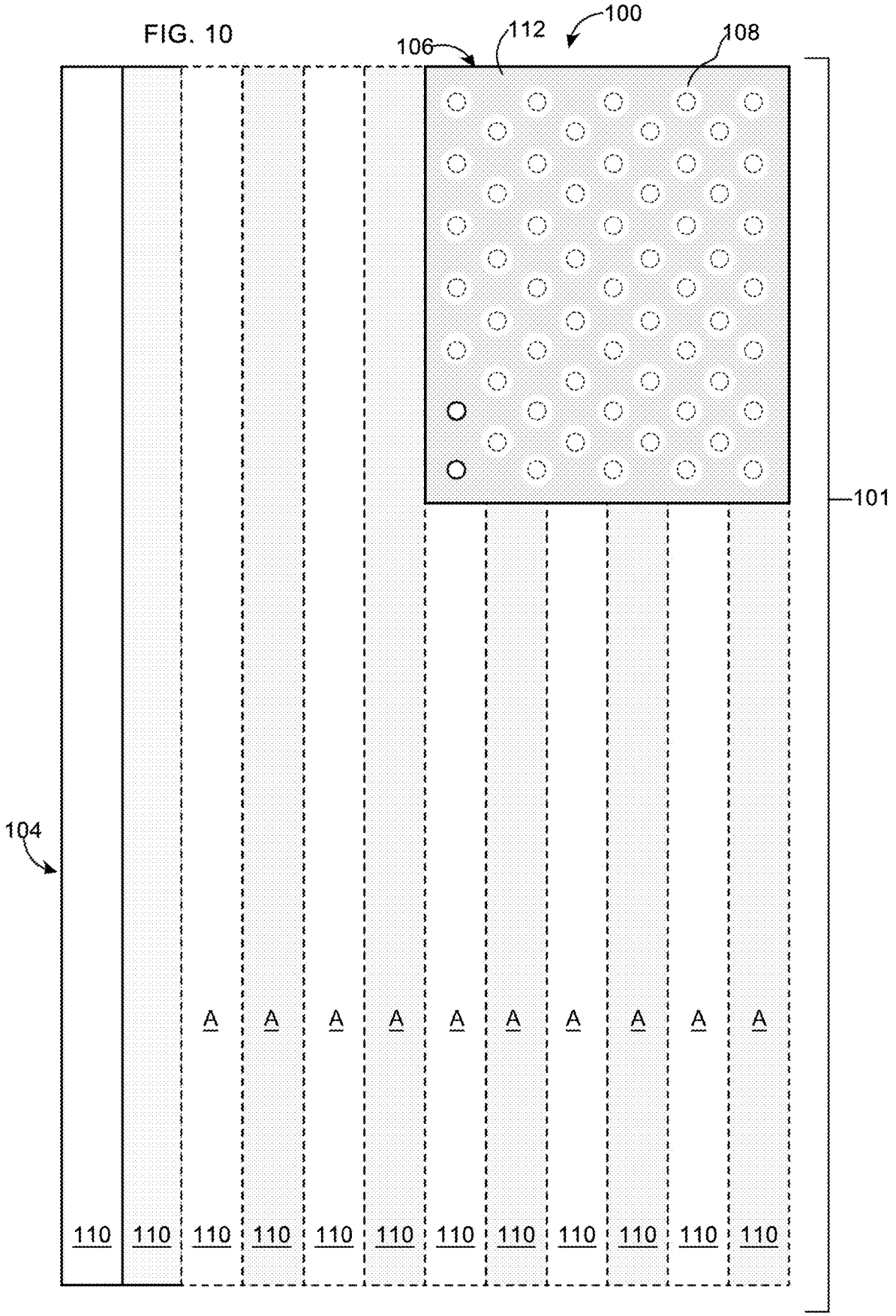
FIG. 10 is a plan view of the example implementation shown in (FIG. 5) displaying the time of 10:57.

FIG. 10 shows the implementation of (FIG. 5) displaying the time of 10:57. Note that 2 of the 59 one-minute indicators are not lighted, and there are 10 active (A) hour indicators.

Figure 11:
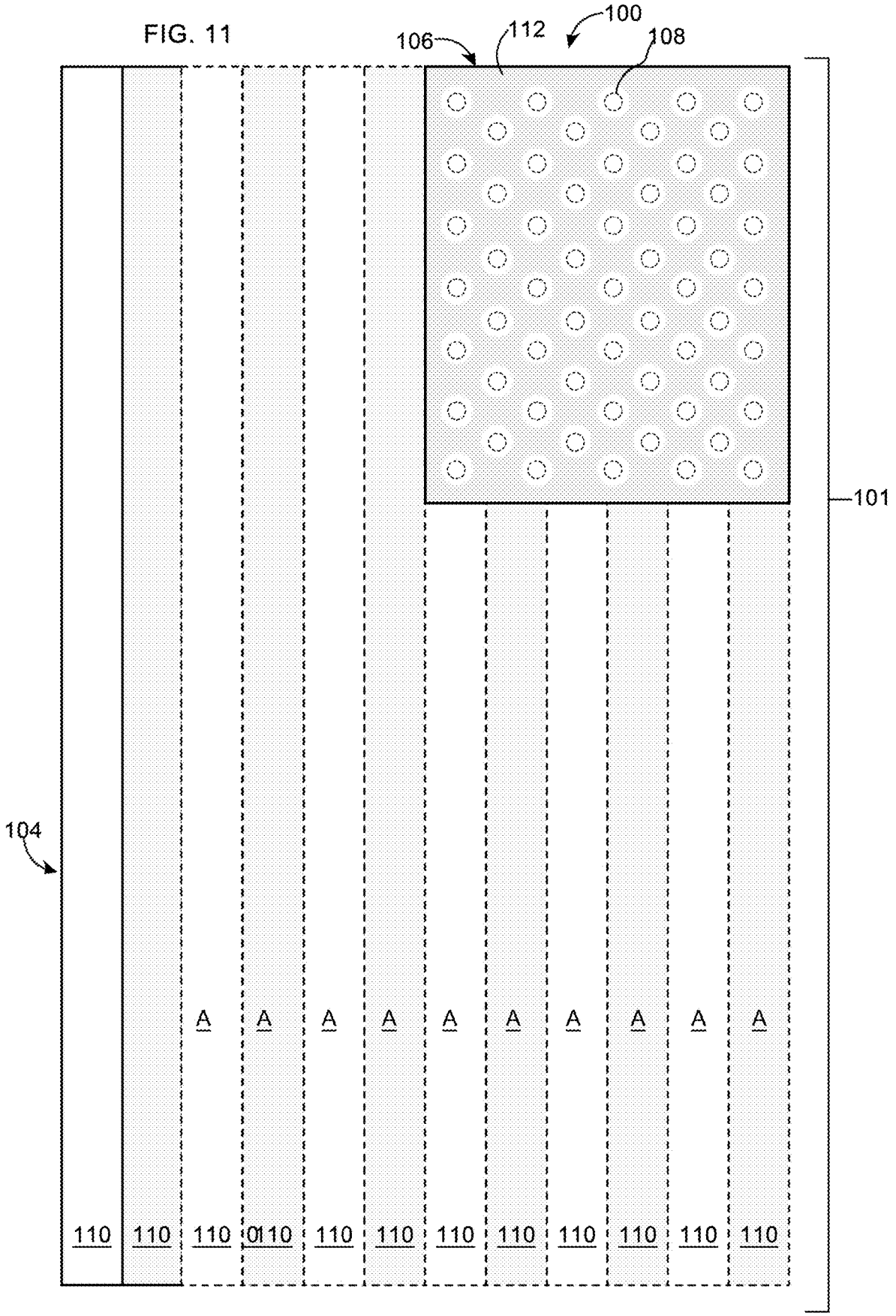
FIG. 11 is a plan view of the example implementation shown in (FIG. 5) displaying the time of 10:59.

FIG. 11 also shows the implementation of (FIG. 5) displaying the time of 10:59. When the time is 11:00, all 59 one-minute indicators will dim and an additional hour indicator will be lighted. At 11:01, one of the 59 one-minute indicators will be sufficiently bright to differentiate it from the inactive one-minute indicators. In some implementations, the background (112) and any inactive hour indicators (110) will still have some backlighting such that the entire field may glow slightly, and the active indicators will be brighter than the inactive elements.

Figure 12:
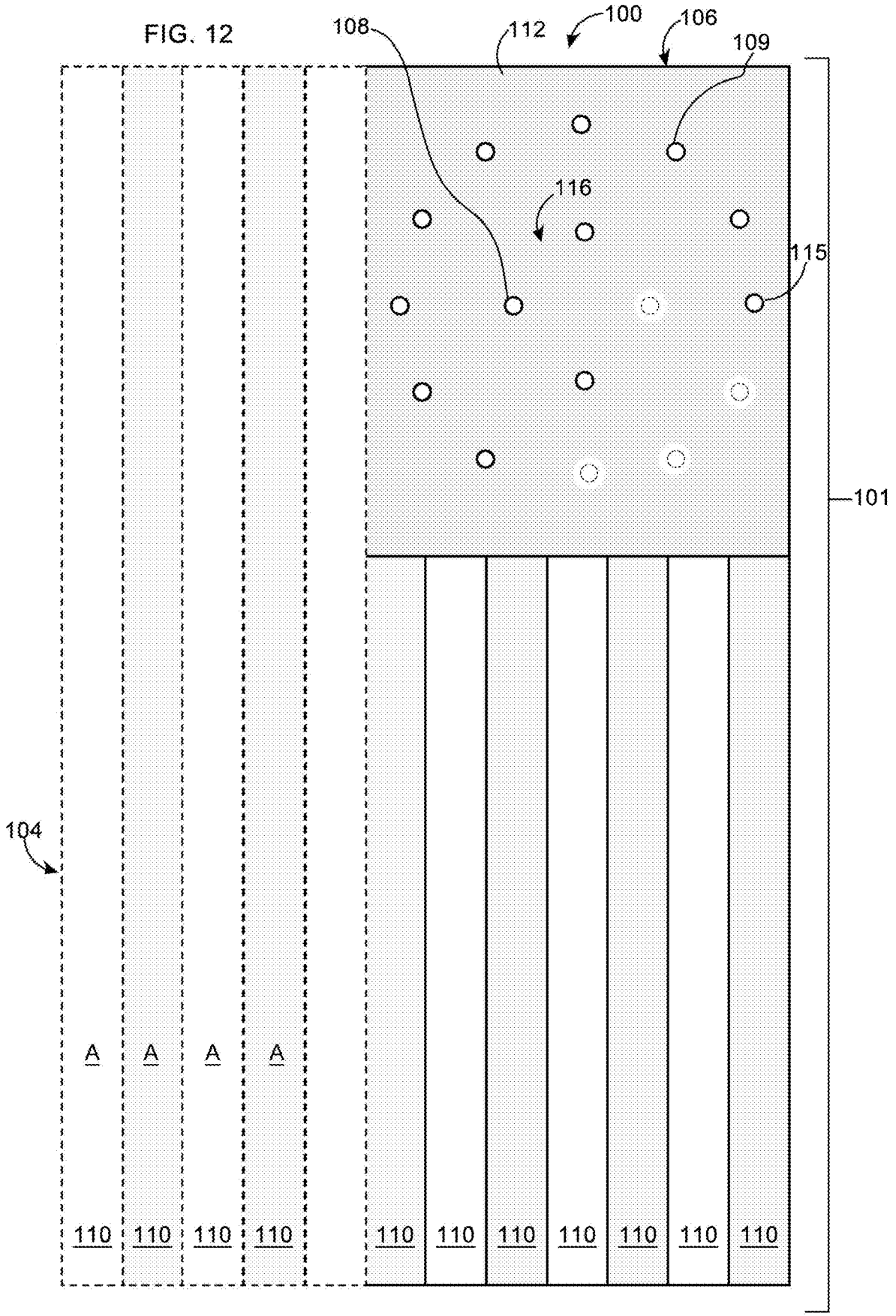
FIG. 12 is a plan view of the example implementation shown in (FIG. 6) displaying the time of 5:16.
Figure 13:
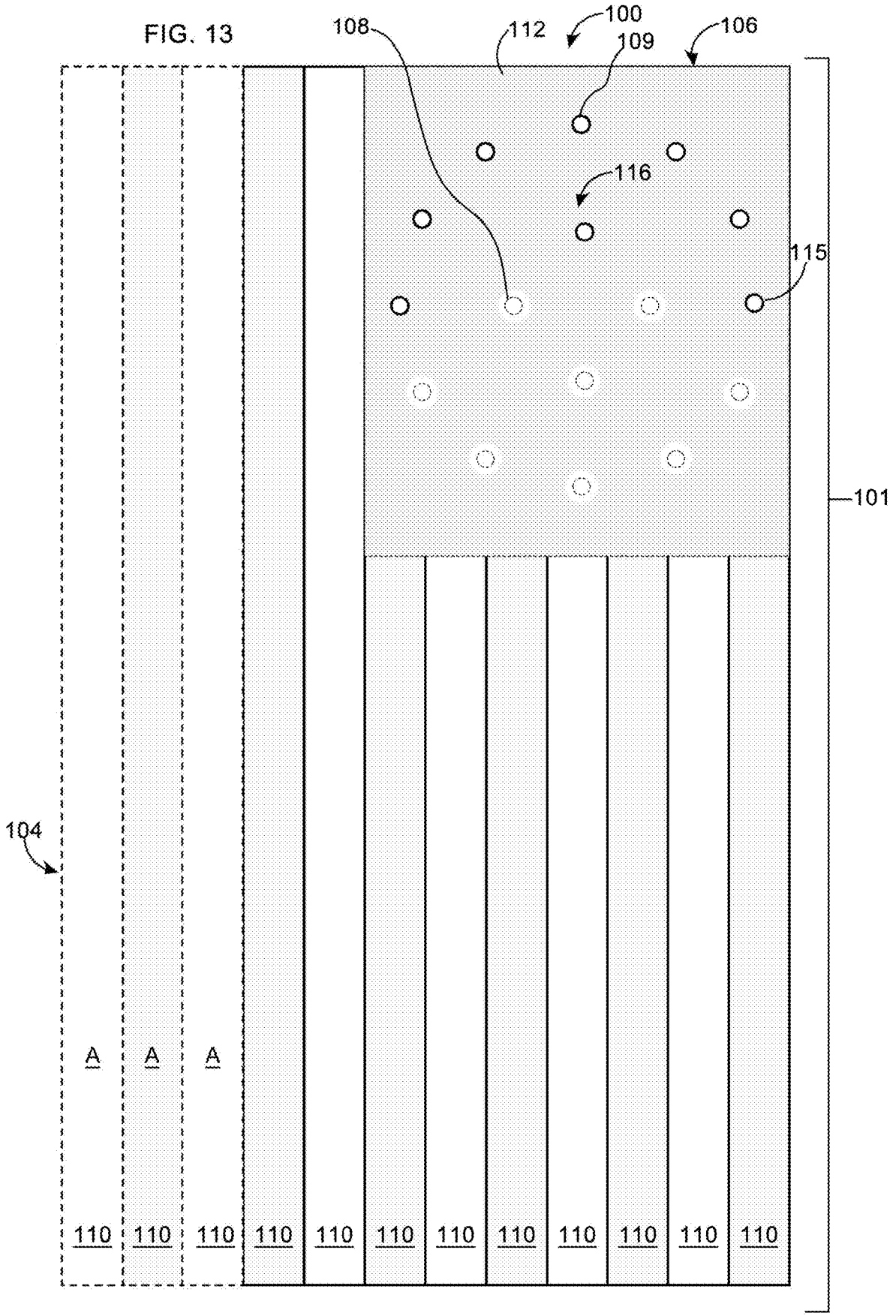
FIG. 13 is a plan view of the example implementation shown in (FIG. 6) displaying the time of 3:28.

FIG. 12 shows the implementation of (FIG. 6) displaying the time of 5:16. Five of the hour indicators are activated starting from the bottom, each of the elements of circular array (114) represent five-minute increments (109), and the 4 central indicators are one-minute indicators (108). In some implementations, whereas the total number of minute indicators may be 16, the five-minute indicator at the 12 position is a placeholder or zero position. In some cases, the total number of five-minute indicators may be 11. In some implementations, the five-minute indicators are counted starting at the 1-o'clock position and moving clockwise. In the illustration, 3 of the five-minute indicators and 1 of the one-minute indicators are active, so the minute count is 16. In FIG. 13, 3 hour indicators, 5 five-minute indicators and 3 of the one-minute indicators are active showing a time of 3:28.

Figure 14:
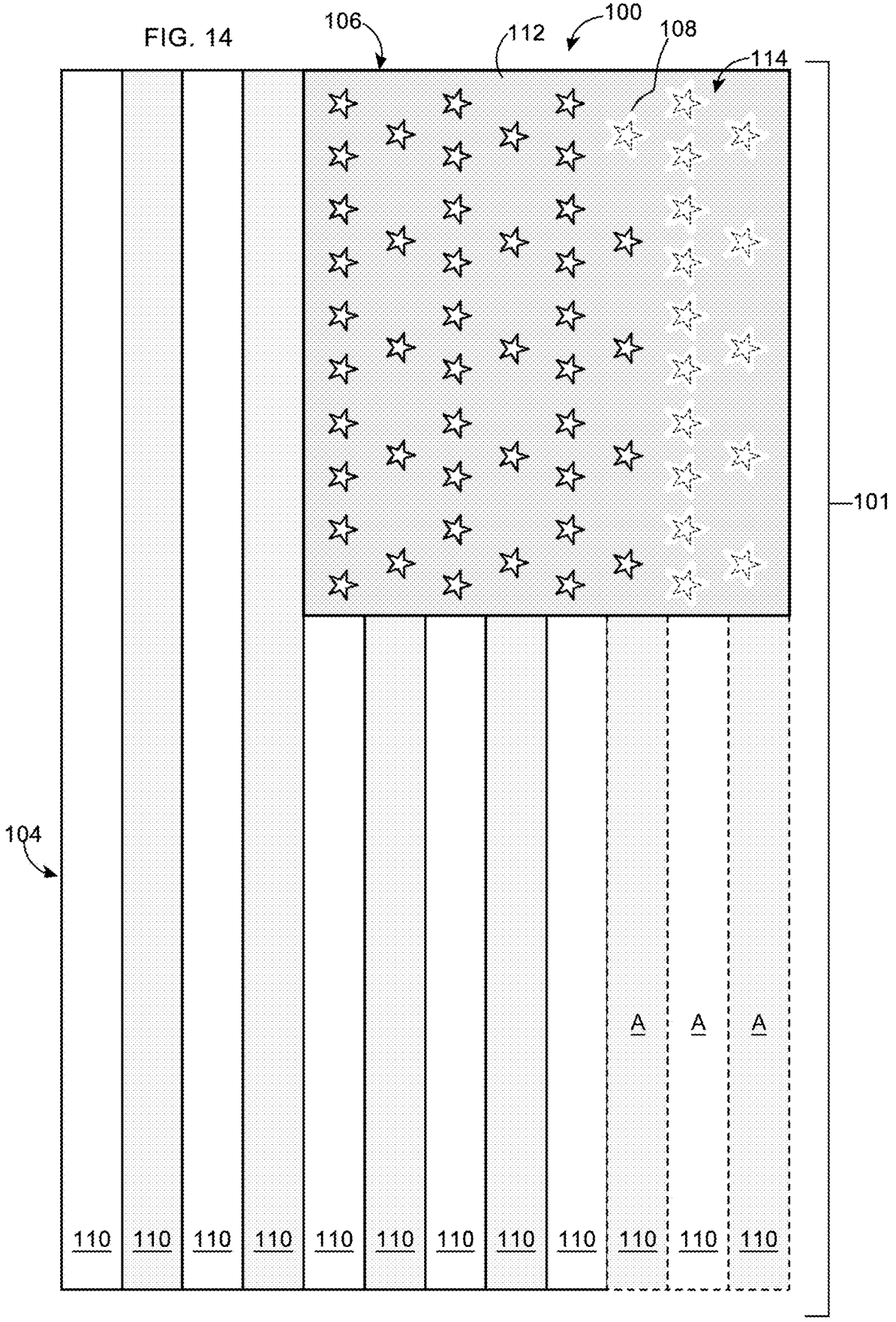
FIG. 14 is is a plan view of the example implementation shown in (FIG. 7) displaying the time of 3:16.

FIG. 14 shows the implementation of (FIG. 7) displaying the time of 3:16.

Figure 15:
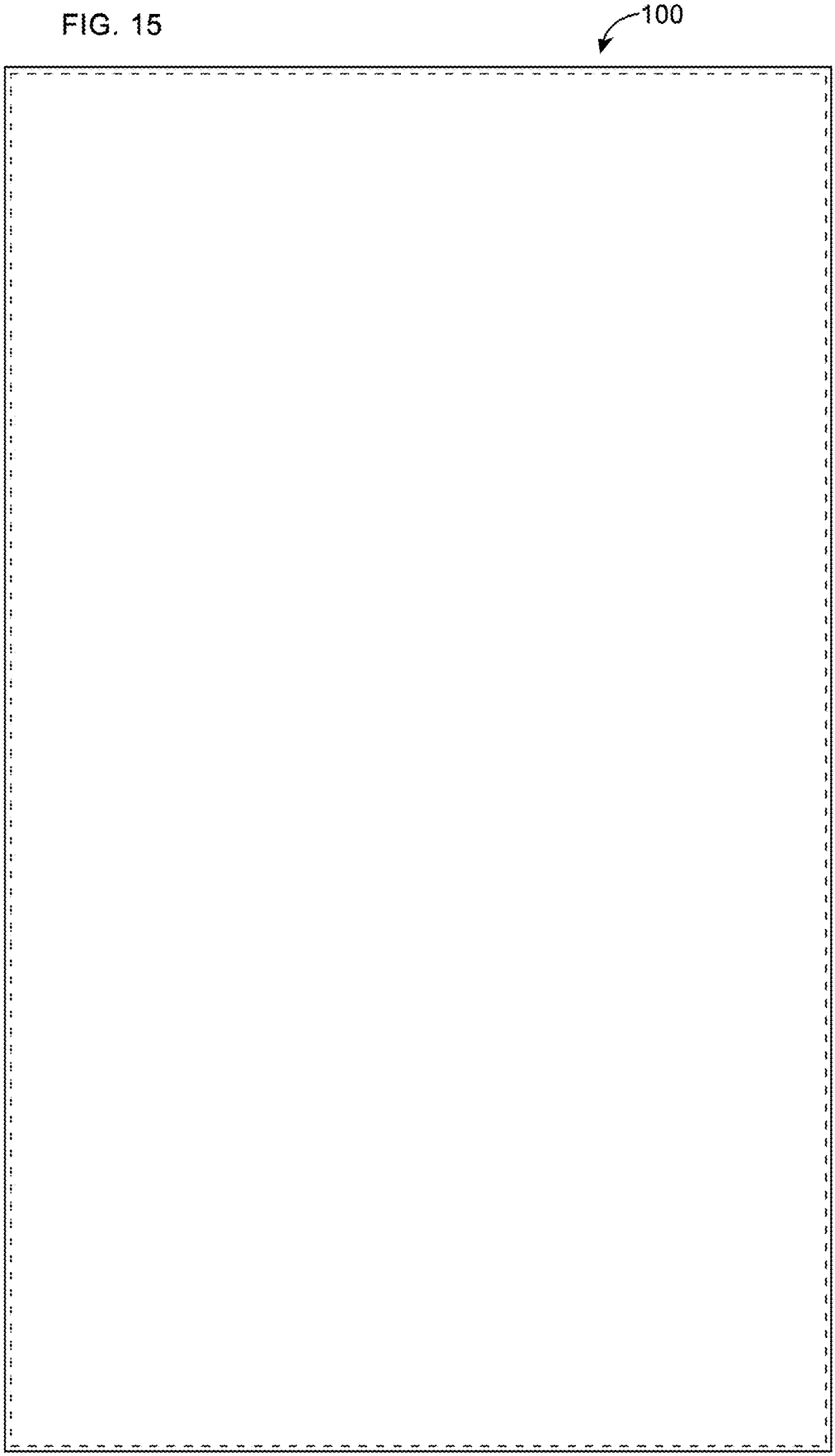
FIG. 15 is a plan view of a back of any of the example implementations.

FIG. 15 shows an example back side of any of the described implementations. Various implementations may be affixed to a wall with any suitable fasteners including hangers, screws, hook and eye, double stick tape, adhesives etc.

Figure 16:
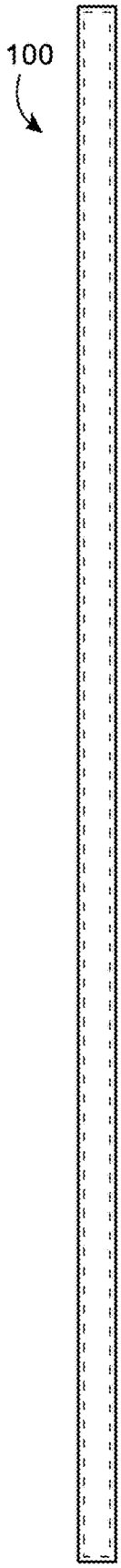
FIG. 16 is a longitudinal side elevation of any one of the example implementations.
Figure 17:
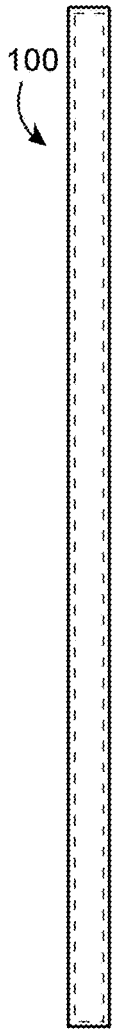
FIG. 17 is a width side elevation of any one of the example implementations.
Figure 18:
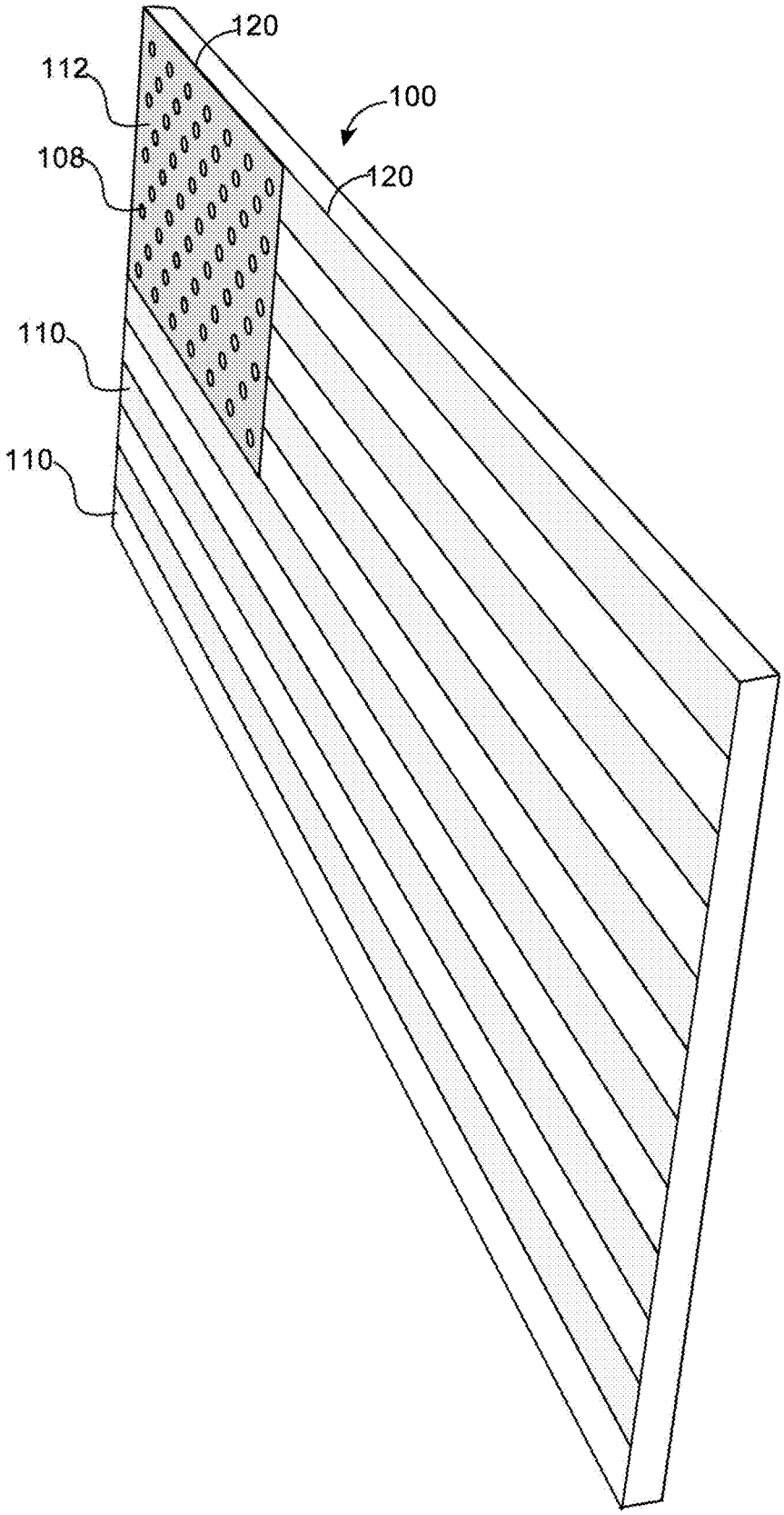
FIG. 18 is a perspective view showing proportions typical of any one of the example implementations.

FIGS. 16 and 17 show example side elevations and relative depth of any of the disclosed implementations.

While FIG. 18 is a perspective view of the example implementation of (FIG. 5), the example proportions are applicable to any one of the disclosed implementations.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. A clock apparatus comprising:

a field having a top, bottom and sides, the field encompassing a first region and a second region;

the first region and second region;

the first region borders the second region and includes an array of minute indicators;

the second region includes a group of stacked hour indicators and each indicator of the group of stacked hour indicators includes a width and a length, and each stacked hour indicator is differentiated from an adjacent stacked hour indicator.

2. The clock apparatus according to claim 1 further comprising a background around the array of minute indicators, at least one edge of the background bordering the second region.

3. The clock apparatus according to claim 1 where the array of minute indicators includes at least 60 indicators.

4. The clock apparatus according to claim 1 where the array of minute indicators is arranged in rows and columns.

5. The clock apparatus according to claim 1 where the array of minute indicators includes at least 59 indicators.

6. The clock apparatus according to claim 1 where the array of minute indicators includes at least 4 one-minute indicators.

* * * * *